US005105975A

United States Patent [19]

Patterson

[11] Patent Number: 5,105,975

[45] Date of Patent: Apr. 21, 1992

[54] NON-SPILL CONTAINER

[75] Inventor: Keith D. Patterson, Providence, R.I.

[73] Assignee: Little Kids, Inc., Providence, R.I.

[21] Appl. No.: 771,165

[22] Filed: Oct. 3, 1991

[51] Int. Cl.[5] ..... A47G 19/22

[52] U.S. Cl. ..... 220/709; 215/1 A; 215/229

[58] Field of Search ..... 220/705, 709; 215/1 A, 215/229

[56] References Cited

U.S. PATENT DOCUMENTS 2,052,496 8/1936 Stassi ..... 215/229

4,869,390 9/1989 Kennedy .

*Primary Examiner*—Stephen Marcus

*Assistant Examiner*—Nova Stucker

*Attorney, Agent, or Firm*—Salter, Michaelson & Benson

[57] ABSTRACT

A non-spill container for preventing the spilling of liquid therefrom when the container is tipped or turned upside down is disclosed. The non-spill container includes a bottom member and a top member that is releasably mounted on the bottom member, the bottom member including an annular wall portion and an annular flange portion. The top member that is joined to the bottom member also includes an upper annular wall portion to which an upper annular flange section is joined at the lowermost end thereof, the flanges of the top and bottom members being interconnected to releasably interlock the top and bottom members together. An opening is formed in the top wall of the top member, and a tube is joined to the underside of the top wall and communicates with the opening, the tube depending coaxially from the top wall interiorly of the upper annular wall section to a location that is adjacent to the upper annular flange, the volume of the lower annular wall portion of the bottom member being somewhat less than the volume of the upper annular wall section through which the tube extends so that liquid contained in the lower annular wall portion of the bottom member is prevented from entering the tube for discharge therethrough when the container is tipped during the use thereof.

8 Claims, 2 Drawing Sheets

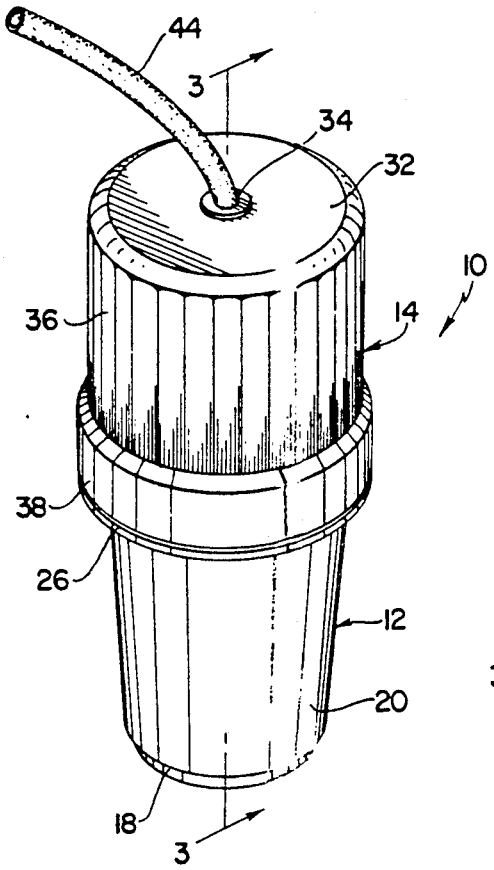
FIG.
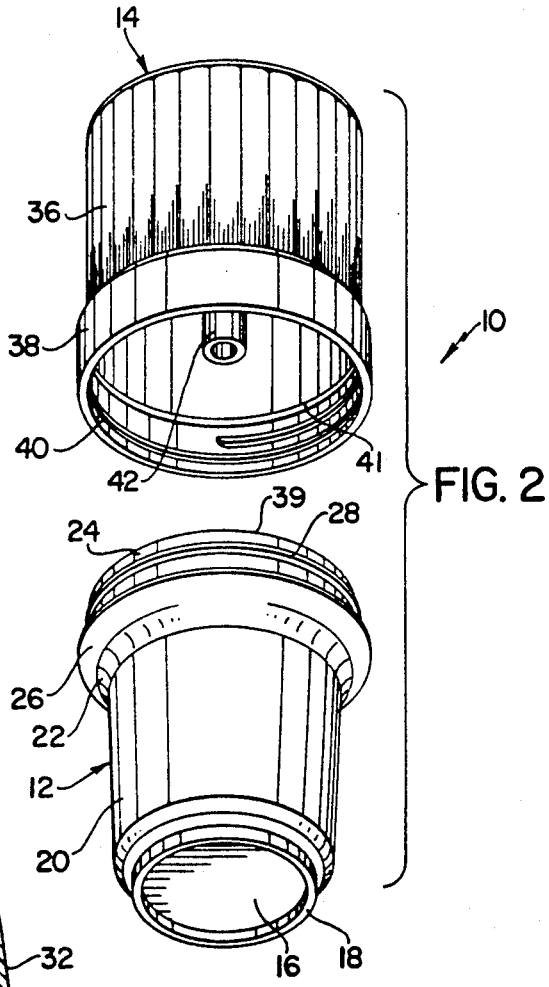
FIG. 2
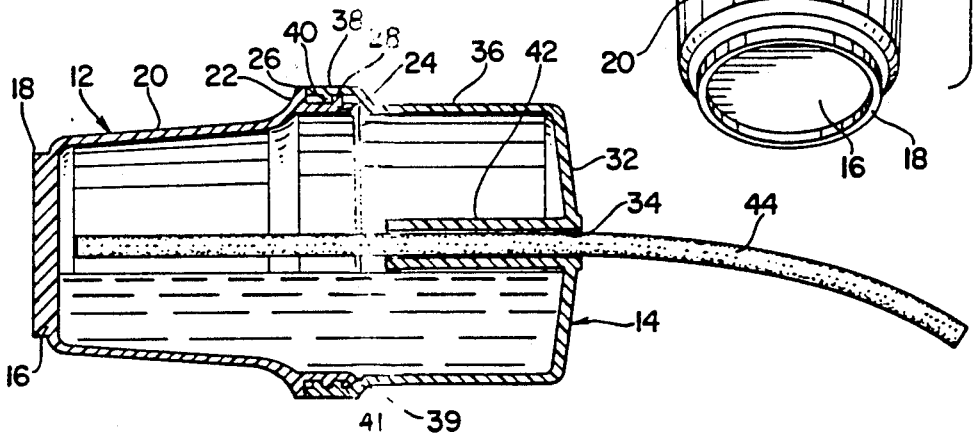
FIG. 3

NON-SPILL CONTAINER

BACKGROUND OF THE INVENTION

The present invention relates to a container that has particular application for preventing the spilling of liquid therefrom where the container is in use, for example, when used by children, in moving vehicles, or when the user is lying in bed.

Prior to the instant invention, several so-called spill-proof containers have been developed, but none of these prior known devices have had particular success in the commercial use thereof because of the difficulties in preventing actual spillage of liquid from the container under all circumstances. One such prior known cup is illustrated in the U.S. Pat. No. 4,869,390, to KENNEDY, which discloses a container having a bottom portion formed in two integral sections. The lowermost section of the bottom portion of the KENNEDY cup was designed to receive the liquid therein, while the integral uppermost section provided a receiver for the liquid when the liquid was tipped in use. As illustrated in the KENNEDY patent, a cap is attached to the top section and includes a tube that extends downwardly therein. When the container is accidentally tipped in use and the liquid enters the upper section of the bottom portion, the tube acts to prevent the liquid from discharging from the container. However, if the user of the cup fills the bottom section beyond the upper level thereof so that the liquid enters the top section, then tipping of the container results in spillage through the tube. Because special instructions were required to advise the user not to fill the bottom section above the top level thereof, the so-called spill-proof cup as illustrated in the KENNEDY patent was not readily accepted by the trade.

Other kinds of containers that have spill-proof features as represented by several of the patents cited in the KENNEDY patent are known in the art, but none of these prior constructions are particularly relevant with respect to the subject invention.

As will be described hereinafter, the non-spill container of the subject invention overcomes the inherent problems as associated with the spill-proof cup of the prior l art and provides a container that is essentially fool-proof in use and prevents spilling of liquid from the container when it is tipped or turned upside down during use.

SUMMARY OF THE INVENTION

The present invention relates to a non-spill container comprising a bottom member and a top member that is releasably mounted on the bottom member. The bottom member includes a bottom wall to which a lower annular wall portion is integrally joined and that extends upwardly therefrom. A lower annular flange portion is joined to the lower annular wall portion at the uppermost end thereof and is substantially reduced in vertical dimension with respect thereto. The top member includes a top wall and an upper annular wall section that is integrally joined to the top wall and depends therefrom. An upper annular flange section is joined to the lowermost end of the upper annular wall section, the upper annular wall section having a vertical dimension that is substantially greater than that of the upper annular flange section of the top member. The upper annular flange section of the top member is releasably mounted in engagement with the lower annular flange portion of the bottom member, and an opening is formed in the top wall of said top member for receiving a straw that enables a user to withdraw liquid from the container. A tube is joined to the underside of the top wall and receives the straw therethrough and communicates with the opening in the top wall, said tube depending coaxially from said top wall interiorly of the upper annular wall section to a location that is adjacent to the upper annular flange section of said top member. The volume of the lower annular wall portion of said bottom member is somewhat less than the volume of the upper annular wall section through which the tube extends so that liquid contained in the lower annular wall portion of the bottom member is prevented from entering the tube for discharge therethrough when the container is tipped sideways or upside down during the use thereof.

Accordingly, it is an object of the present invention to provide a non-spill container having a bottom member and a separate top member that is releasably mounted on the bottom member, the volume of the bottom member being somewhat less than the volume of the top member, and a tube extending interiorly into the top member so that when the container is tipped, the liquid that enters the top member from the bottom member is prevented from entering the tube for discharge from the container.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a perspective view of the assembled non-spill container as embodied in the subject invention;

FIG. 2 is an exploded perspective view showing the top and bottom members of the subject invention as removed from the assembled position;

FIG. 3 is a vertical sectional view taken along lines 3—3 in FIG. 1, and illustrating the distribution of the liquid in the container when the container is tipped to a sideways position;

DESCRIPTION OF THE PREFERRED EMBODIMENT

Figure 4:
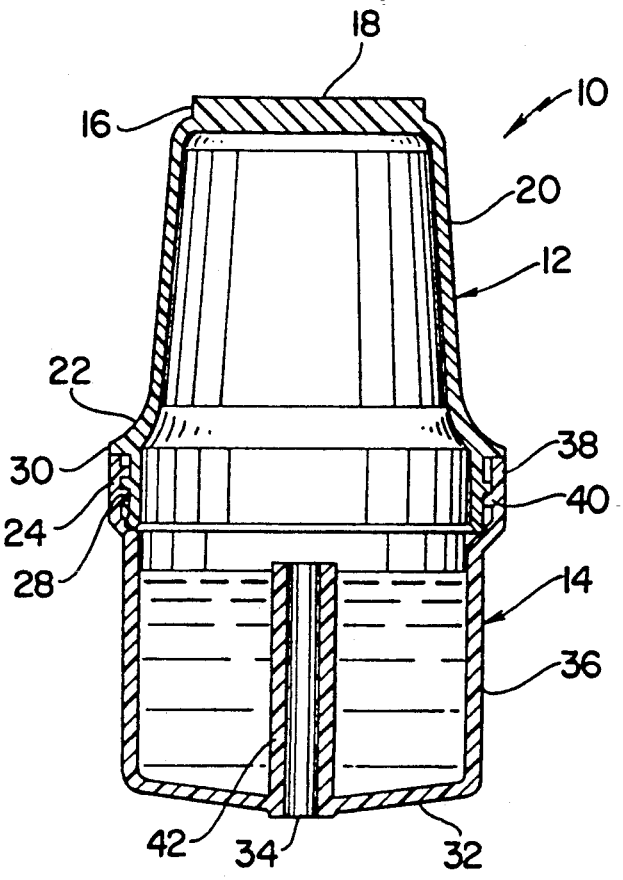
FIG. 4 is a vertical sectional view of the container as illustrated in an upside down position, the level of the liquid in the top member of the container being shown relative to the interior tube whereby the liquid is prevented from spilling from the container.

Referring now to the drawings, and particularly to FIGS. 1 and 2, the non-spill container of the subject invention is illustrated and is generally indicated at 10. The spill-proof container 10 includes a bottom member generally indicated at 12 on which a top member generally indicated at 14 is releasably mounted. The bottom member 12 includes a bottom wall 16 formed with a lower annular ring-like foot portion 18 and to which an annular lower cup-like wall portion 20 is joined. The annular lower wall portion 20 is flared at the upper end thereof as indicated at 22, and joined thereto at the upper end thereof is an upper annular flange portion 24.

The flange portion 24 which defines an open mouth for said cup-like wall portion 20 includes a lower annular ring 26 that has a diameter that is substantially greater than the diameter of the lower annular wall portion 20. The lower flange portion 24 also includes an annular external threaded section 28 that has a diameter that is less than that of the ring 26 but that is greater than that of the lower annular wall portion 20. As will be described a flange of the top member 14 is formed with a diameter similar to that of the annular ring 26 and in the assembled position of the top and bottom members is located closely adjacent to the annular ring 26.

Figure 5:
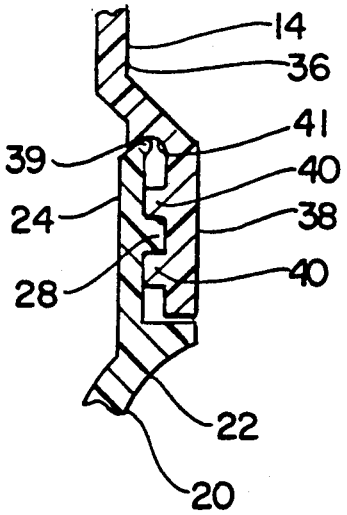
FIG. 5 is an enlarged sectional view showing the engaged threaded portions of the lower and upper annular flanges of the bottom and top members.

Referring now to FIGS. 1 and 3, the top member 14 is more clearly illustrated and includes a top wall 32 in which an opening 34 is formed. Integrally joined to the top wall 32 and extending downwardly therefrom is an inverted cup-like upper annular wall section 36 to which an upper annular flange 38 is integrally joined. As seen in FIG. 3, the upper annular flange 38, which defines an open mouth for the annular wall section 36, has threads 40 formed thereon that threadably engage the threads 28 as formed on the lower flange 24 of the bottom member for locking the open mouths of the top and bottom members together in the assembled position of the container. As more clearly illustrated in FIG. 5, the uppermost end of the lower annular flange 24 is formed with an inwardly extending upper annular beaded edge 39 that is received in an annular interior groove 41 that is formed in the upper portion of the upper flange 38. It is seen that the interengagement of the annular beaded edge 39 with the annular groove 41 acts to seal the interior of the container in the assembled position of the top and bottom members, and to prevent leakage of liquid through the threadably engaged flanges 24 and 38.

As further illustrated in FIG. 3, an interior tube 42 is joined to the top wall of the top member 14 and extends interiorly of the upper annular wall section 36. The lowermost end of the tube 42 is disposed adjacent to the upper annular flange 38 of the top member 14, the location of the lowermost end of the tube 42 being critical relative to preventing the discharge of the liquid in the container when the container is tipped or turned upside down.

In order to prevent the spillage of liquid from the container when the top and bottom members thereof are secured in the assembled position thereof as shown in FIG. 3, the lower annular wall section 20 is constructed such that the interior volume thereof is somewhat less than the volume of the interior of the upper annular wall section 36. In order to emphasize the differences in volume between the lower and upper annular wall sections, reference is made to FIG. 4, wherein liquid that had been filled to the upper level of the lower annular wall section 20 has been emptied into the upper annular wall section 36 when the container is turned upside down. As shown, the upper level of the liquid as emptied into the upper annular wall section 36 is just below the interior innermost end of the tube 42. Thus, the liquid is prevented from passing into the tube 42 and is thereby prevented from spilling or discharging from the container.

Referring again to FIG. 3, the container 10 is shown as tipped on its side during a use thereof, and in this position, the liquid in the lower annular wall section 20 has drained or passed into the upper annular wall section 36. However, since the level of the liquid in the two sections 20 and 36 does not reach the level of the opening in the tube 42, the liquid can still not spill from the container through the tube 42 and the opening 34 as formed in the top wall 32.

In normal use of the non-spill container, liquid may be poured into the lower annular wall section up to its maximum level at the top of the flange 38. The member 14 is then tightly mounted on the bottom member 12 by rotating the top member relative to the bottom until the beaded edge 39 of the flange 24 firmly engages the groove 41 of the flange 38. Thereafter, a straw 44 is inserted through the opening 34 in the top wall 32 and through the tube 42 into the interior of the lower annular wall portion 20. The user of the container may then withdraw the liquid therefrom through the straw in the conventional manner. However, should the container be tipped in use as shown in FIG. 3 or turned upside down as illustrated in FIG. 4, the liquid that is disposed in the lower annular wall portion 20 is prevented from discharging through the tube 42 and the opening 34 in the top wall 32 as described hereinabove.

It is seen that the non-spill container of the subject invention has particular application when used by children, since it is designed to eliminate accidental spills and prevents the liquid from discharging from the cup onto the clothing of the user or onto carpets or furniture. Further, if the container is utilized in a moving vehicle, sudden stops of the vehicle, which could result in tipping of the container, will not result in spillage of the liquid from the container onto the user or onto the seats or floor of the vehicle. It is also understood that the material from which the top and bottom members 12 and 14 are formed is of any suitable rigid, plastic material that is dishwasher safe and can be cleaned with relative ease. It is also seen that the tube 42 can accommodate any convenient straw, as desired.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A non-spill container, comprising a bottom member and a top member that is releasably mounted on said bottom member, said bottom member including a bottom wall to which a lower annular wall portion is integrally joined and that extends upwardly therefrom, a lower annular flange portion being joined to said lower annular wall portion at the uppermost end thereof and being substantially less in vertical dimension with respect thereto, said top member including a top wall and an upper annular wall section that is integrally joined to said top wall and that depends therefrom, and an upper annular flange section joined to the lowermost end of said upper annular wall section, said upper annular wall section having a vertical dimension that is substantially greater than the upper annular flange section of said top member, the upper annular flange section of said top member being releasably mounted in engagement with the lower annular flange portion of said bottom member, an opening formed in the top wall of said top member for receiving a straw for withdrawing liquid from the container, and a tube joined to the underside of said top wall and receiving said straw therethrough and communicating with said opening, said tube depending coaxially from said top wall interiorly of said upper annular wall section to a location that is adjacent to the upper annular flange section of said top member, said straw extending through said tube and into said bottom member, the volume of the lower annular wall portion of said bottom member being somewhat less than the volume of the upper annular wall section through which the tube extends so that liquid contained in the lower annular wall portion of said bottom member is prevented from entering said tube for discharge therethrough when the container is tipped during use thereof.

2. A non-spill container as claimed in claim 1, the lower annular flange portion of said bottom member being substantially less in vertical dimension than that of the lower annular wall portion.

3. A non-spill container as claimed in claim 2, said lower annular flange portion of said bottom member having a diameter that is greater than that of said lower annular wall portion.

4. A non-spill container as claimed in claim 3, the upper annular flange section of said top member having a diameter that is greater than that of said upper annular wall section.

5. A non-spill container as claimed in claim 4, the vertical dimension of said upper annular flange section of said top member being substantially less than that of said upper annular wall section.

6. A non-spill container as claimed in claim 5, said lower annular flange having an upper beaded edge formed on the upper portion thereof, and said upper annular flange having an annular groove formed thereon adjacent to the upper end thereof, a threaded portion formed on said upper annular flange below said beaded edge, said lower annular flange having a threaded portion formed thereon for engagement with the threaded portion of said upper annular flange, the upper beaded edge of said lower annular flange section engaging said annular groove in said upper annular flange to form a liquid seal therewith.

7. A non-spill container as claimed in claim 1, the longitudinal dimension of said tube being substantially the same as the longitudinal dimension of said upper annular wall section, wherein liquid is prevented from entering said tube during the use of said container.

8. A non-spill container, comprising a cup-like bottom member that receives liquid therein and having a bottom wall and an open upper mouth, an inverted cup-like top member having a top wall and an open lower mouth, said top member being releasably mounted on said bottom member in a sealed position with the open mouths thereof in communication with each other, a tube joined to the underside of said top wall and extending interiorly into said top member, and a straw extending through said tube into said bottom member for use in withdrawal of liquid therefrom, the volume of said bottom member being somewhat less than the volume of said top member so that when the container is tipped in use, the liquid that flows into the top member from the bottom member is prevented from entering the tube for discharge from the container.

* * * * *